US007870773B2

(12) United States Patent
Tingley, III et al.

(10) Patent No.: US 7,870,773 B2
(45) Date of Patent: Jan. 18, 2011

(54) INSERTED WIPER DIE FOR HIGH-PRESSURE TUBE-BENDING AND METHOD OF USING SAME

(75) Inventors: William Q. Tingley, III, Grand Rapids, MI (US); William Q. Tingley, Grand Rapids, MI (US); Daniel R. Bradley, Grand Rapids, MI (US)

(73) Assignee: Tennine Corporation, Grand Rapids, MI (US)

( * ) Notice: Subject to any disclaimer, the term of this patent is extended or adjusted under 35 U.S.C. 154(b) by 487 days.

(21) Appl. No.: 11/680,338

(22) Filed: Feb. 28, 2007

(65) Prior Publication Data

US 2008/0202186 A1 Aug. 28, 2008

(51) Int. Cl.
*B21D 7/04* (2006.01)

(52) U.S. Cl. ..... 72/157; 72/155

(58) Field of Classification Search ..... 72/157, 72/149, 154, 155, 158, 159, 150, 367.1, 368, 72/369

See application file for complete search history.

(56) References Cited

U.S. PATENT DOCUMENTS

| | | | | | |
|---|---|---|---|---|---|
| 2,777,500 | A | | 1/1957 | Ekholm et al. | |
| 3,118,488 | A | | 1/1964 | Barnhill | |
| 3,456,482 | A | * | 7/1969 | Cwik et al. | 72/466.2 |
| 3,475,938 | A | | 11/1969 | Whitney, Jr. et al. | |
| 3,557,586 | A | | 1/1971 | Zmuda | |
| 3,650,136 | A | | 3/1972 | Sindelar | |
| 4,126,030 | A | | 11/1978 | Zollweg et al. | |
| 4,325,244 | A | * | 4/1982 | Stowe et al. | 72/158 |
| 4,380,920 | A | * | 4/1983 | Coop et al. | 72/158 |
| 4,760,727 | A | | 8/1988 | Van Landingham | |
| 4,899,567 | A | * | 2/1990 | Lenglet et al. | 72/159 |
| 4,959,984 | A | | 10/1990 | Trudell et al. | |
| 5,287,717 | A | * | 2/1994 | Lancaster | 72/332 |
| 5,979,204 | A | * | 11/1999 | Stange | 72/159 |
| 6,820,450 | B2 | | 11/2004 | Yamada et al. | |
| 7,293,444 | B2 | * | 11/2007 | Hacker et al. | 72/158 |
| 2005/0150268 | A1 | * | 7/2005 | Coop | 72/157 |

* cited by examiner

*Primary Examiner*—Edward Tolan
(74) *Attorney, Agent, or Firm*—Price, Heneveld, Cooper, DeWitt & Litton, LLP

(57) ABSTRACT

The present invention is a wiper die assembly that combines the performance of a solid-body wiper die with the economy of a inserted wiper die for high-pressure rotary-draw tube-bending. The key features of the present invention are: [1] A wiper insert attached to the wiper holder by a mechanical means that retains the bore of the insert as a smooth, uninterrupted working surface, and [2] radius face support shoe attached to the wiper holder that can be adjusted to support and stabilize the entire wiper assembly against the cavity of the bend die.

14 Claims, 3 Drawing Sheets

INSERTED WIPER DIE FOR HIGH-PRESSURE TUBE-BENDING AND METHOD OF USING SAME

FIELD OF THE INVENTION

The present invention relates generally to tube bending and, more particularly, to a method and apparatus for high-pressure rotary-draw tube-bending.

BACKGROUND

In rotary-draw tube-bending the tools make the bend. Indeed, that is why the process is often called "mandrel bending." Despite the many advances in tube-bending machinery, the rotary-draw process is mechanically identical to what it was a half-century ago when modern tube-bending tools made their first appearance. Therefore, the central importance of the tools in making repeatable high-quality tube bends back then remains just as important today. Small variations or errors in the design, manufacture, or set-up of rotary-draw tools can lead to loss of process control, poor bend quality, abbreviated tool life, and other headaches.

FIG. 1 illustrates a cross-sectional view, through the plane of bend, of the operation of a wiper die assembly 100 that is known in the prior art. The wiper die 101 is a block machined to fit the gap between a bend die 103 and the back tangent 105 of the tube 107 to be bent. The essential element of the wiper die 101 is the knife-like feathered edge 109, which is formed by the intersection of two curved surfaces of the wiper die 101: [1] The bore into which the back tangent 105 of the tube 107 nests, and [2] the radius face against which the bend die 103 bears. Typically, the wiper die 101 is a two-piece assembly comprised of a wiper holder 111 and a wiper insert 113, which features the feathered edge 109. The wiper insert 113 is disposable. Alternatively the wiper die 101 can be a solid block.

The bore of a wiper die will vary with the shape and size of the tube to be bent. The radius face will vary for the same reasons plus the radius of the tube bend. The material of the wiper die is usually metal, although plastic and wood have been used. Occasionally the bore, and less often the radius face, is plated or coated to reduce friction during bending. The material of the wiper die is determined by the material of the tube with durability and friction the primary considerations. Other than size and material, there are no rigid specifications for a wiper die. Most of the tool is nothing but mass to support the feathered edge, to provide sufficient surface area for mounting the wiper die to the tube-bending machine, and in the case of high-pressure tube-bending to act as a backstop for the pressure the tube-bending machine applies to the tube during the rotary-draw tube-bending process. Although the feathered edge is the essential element of a wiper die, no design standard has emerged for it.

The wiper die 101 serves two functions in the rotary-draw tube-bending process. The first is to prevent a hump from forming at the inward half of the back tangent 105 immediately behind the line of tangency 117 when the tube 107 comes to rest at the end of the bending process. As the tube 107 is being drawn around the bend die 103 to form the bend 115, it becomes plasticized at the point of bend 119, which is the region of the tube 107 both ahead of and behind the line tangency 117 being formed into the bend 115. The plasticized material behind the line of tangency 117 continuously flows into the curve of the bend die cavity 103 that is sweeping away from the back tangent 105 of the tube 107, thus forming a hump. As this humped material is draw through the line of tangency 117 it is flattened out. However, if this deformation exceeds the elasticity of the tubing material, the hump or a series of small humps will set in the back tangent 105. Fixturing a wiper die 101 in the gap between the bend die 103 and the back tangent 105 of the tube 107 stops the deformation from reaching that point by blocking the flow of the material. Because all tubing materials have some elasticity, i.e., the property of resuming its original shape when stress is relieved, it is not necessary to fixture a wiper die 101 so that it fills the entire gap to prevent the formation of this hump. As seen in FIG. 1, a wiper can be "raked" as shown by angling the back end of the wiper die 101 from point $R_a$ (i.e., "zero-rake") and point $R_b$ so that it blocks only that amount of the flow that would exceed the elasticity of the material. The advantage of this technique is longer tool life. In instances where a worn wiper die was set at little or zero-rake, the bore immediately behind the feathered edge 109 is "dished" out from blocking the entire flow of material. This dishing reduces the usable life of a wiper die.

However, raking a wiper die to extend its life can be at odds with its second function, which is full containment of the tubing material at the point of bend when bending under high pressure. Normally, high pressure as radially applied by the pressure die (not shown) against the back tangent 105 of the tube 107 opposite of the wiper die 101 is not necessary in most rotary-draw tube-bending applications. However, higher pressures often cannot be avoided for bending materials such as stainless steel or titanium or even mild steel on an extremely tight bend radius 115. These materials resist the compression that occurs as the intrados of the tube bend 115 (approximately the wall of the inward half of the tube 107) thickens during the bending process. If the flow of material is not completely contained by tooling at the point of bend 117—i.e., the mandrel (not shown) inside in the tube 107, the pressure die (not shown) over the outward half of the back tangent 105, the bend die over the inward half of the tube bend 115, and the wiper over the inward half of the back tangent 105—the compression will buckle the intrados.

FIGS. 2A and 2B illustrate a side view and end view of a traditional solid-body wiper die 200 as used in the prior art. The solid-body wiper die is a solid block 201 with one or more tapped holes 203 at its back end for mounting it to a post or other fixturing device of the tube-bending machine (not shown). The front end is a compound curved face formed by the arc of the bore 205, into which the back tangent of the tube nest, swept along the arc of the radius face 207, which mates with the bend die cavity, starting from the feathered edge 209 to the top of the wiper block 201. Typically the tapped holes 203 do not extend into the bore 205, thus there are no interruptions to the smooth surface of the bore. Similarly, the radius face 207 is an uninterrupted smooth surface. Therefore, therefore are no discontinuities in these two surfaces which act as bearings—to wit, the bore 205 against the radial pressure of the pressure die as applied through the back tangent of the tube and the radius face 207 against the bend die cavity—when a solid-body wiper die 200 is mounted at zero-rake for high-pressure tube-bending. For this reason, along with its generally large mass, the solid-body wiper die 200 is preferred for high-pressure tube-bending.

FIGS. 3A and 3B illustrate a side view and end view of a standard inserted wiper die 300 as used in the prior art. FIG. 3C is a side view of the wiper insert component 303 of that assembly 300. In contrast to the solid-body wiper die 200, the inserted wiper die 300 is a two-piece unit consisting of a wiper holder 301 and a wiper insert 303. The insert 303 is attached to the holder by means of a screw 305. The wiper holder 301 functions in a manner similar to the block 201 of the solid-body wiper die 200. The back end of it has one or more tapped holes 307 to mount the entire wiper assembly 300 to the tube-bending machine. It otherwise does no work during the rotary-draw tube-bending process. The only working surfaces of the inserted wiper die are those of the bore 309 and the radius face 311 of the wiper insert 303. Together these surfaces form the feathered edge 313 of the wiper insert 303. When one of these features wears out, the wiper insert 303 is detached from the wiper holder and replaced with a new one. Replacing an insert is less costly than either re-machining the worn bore 205, radius face 207, or feathered edge 209 of a solid-body wiper 200 or disposing of it. For this reason, the inserted wiper die 300 is preferred for all rotary-draw tube-bending except high-pressure tube-bending.

The inserted wiper die 300 lacks the mass and uninterrupted working surfaces of the solid-body wiper die 200. Because the only function of the wiper holder 301 is to act as a fixture for the wiper insert 303, its bore 315 and radius face 317 are offset from the corresponding surfaces 309, 311 of the insert 303 so as to not incur unnecessary wear. Also because of this limited function the holder 301 has only the mass necessary to support the insert 303. A consequence of this reduced bulk of the holder 301 relative to the block 201 of a solid-body wiper die 200 is that its tapped holes 307 go through its body into the bore 315, which are additional interruptions to the overall continuity of the bore 309, 315 of the inserted wiper die 300. Because of the lack of mass and interrupted working surfaces of the inserted wiper die 300, it is not suited for high-pressure tube-bending.

Therefore, the need exists for a wiper die that incorporates both the performance of the solid-body wiper 200 and the economy of the inserted wiper die 300. The present invention overcomes the shortcomings of all other wiper dies and methods of use as an inserted wiper die with continuous working surfaces and sufficient mass necessary for effective performance in high-pressure tube-bending.

BRIEF DESCRIPTION OF THE FIGURES

The present invention will now be described with reference to the accompanying drawings wherein like reference numerals in the following written description correspond to like elements in the several drawings identified below.

Figure 1:
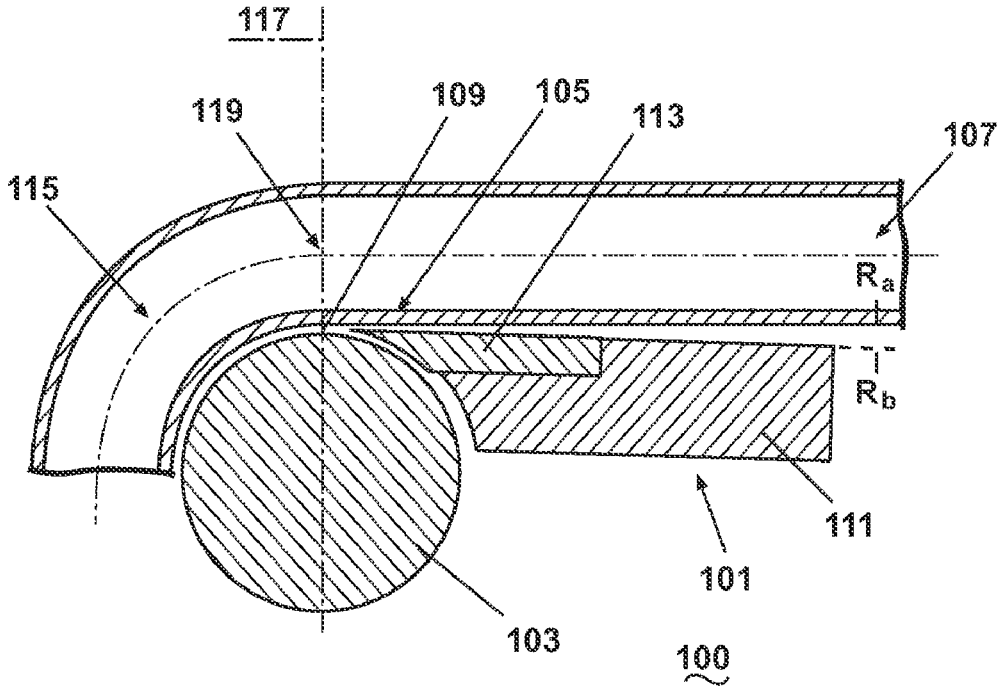
FIG. 1 (PRIOR ART)
FIG. 1 is a cross-sectional view, through the plane of bend, of the operation of an inserted wiper die known in the prior art.
Figure 2A:
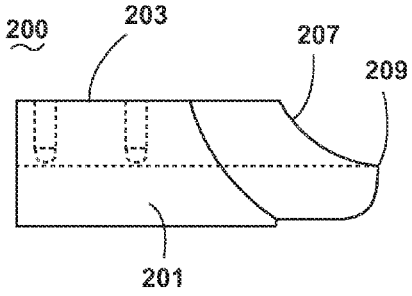
FIG. 2A (PRIOR ART)
FIGS. 2A and 2B are side and front views, respectively, of a traditional solid body wiper die.
Figure 2B:
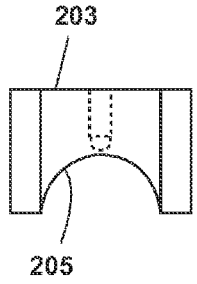
FIG. 2B (PRIOR ART)

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a wiper die having an adjustable support shoe. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 3A:
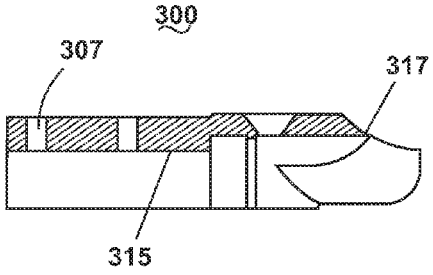
FIG. 3A (PRIOR ART)
FIGS. 3A and 3B are side and front views, respectively, of an inserted wiper die.
Figure 3B:
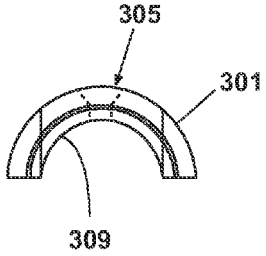
FIG. 3B (PRIOR ART)
Figure 3C:
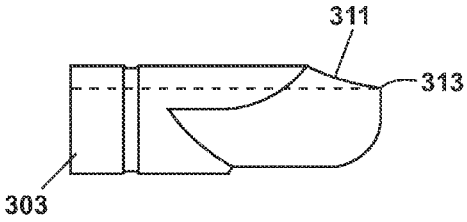
FIG. 3C (PRIOR ART)
FIG. 3C is a side view of the wiper insert component of the assembly shown in FIGS. 3A and 3B.
Figure 4A:
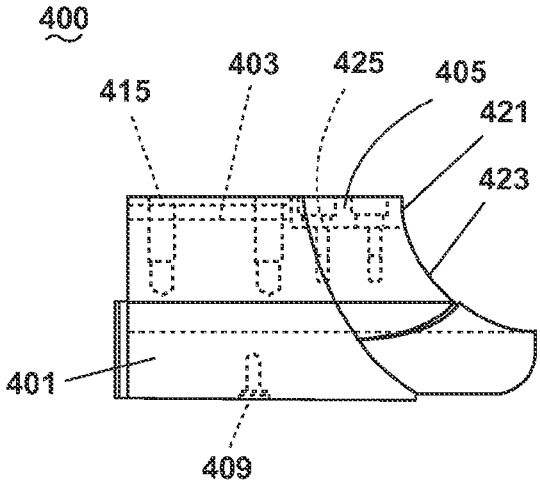
FIGS. 4A and 4B are side and back views, respectively, of an embodiment of the present invention, an inserted wiper die for high-pressure tube-bending.
Figure 4B:
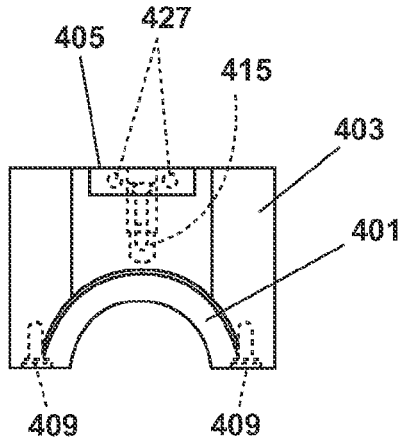
Figure 4C:
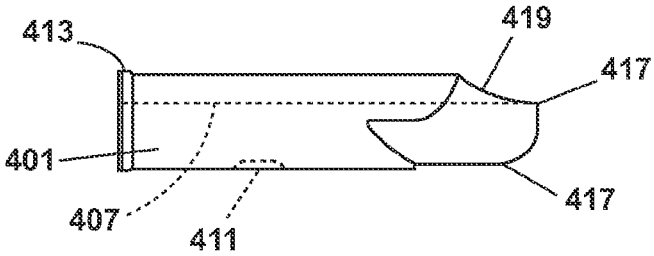
FIG. 4C is a side view of the wiper insert component of the assembly shown in FIGS. 4A and 4B.

FIGS. 4A, 4B and 4C illustrate various views of a high-pressure wiper die assembly 400 in accordance with an embodiment of the present invention. FIGS. 4A and 4B are side and back views, respectively, of the high-pressure wiper die assembly 400. The assembly 400 includes three major components: [1] A wiper insert 401, [2] a wiper holder 403, and [3] a radius face support shoe 405. FIG. 4C is a side of the wiper insert 401. Unlike the pocket-type wiper insert 303 depicted in FIGS. 3A, 3B, and 3C, the high-pressure wiper insert 401 is in the form of a sleeve with a smooth, continuous, uninterrupted surface for the bore 407. This allows the full length of the wiper die's bore 407 to be used as a linear bearing for tube-bending (not shown). Those skilled in the art will recognize that this is necessary for high-pressure bending. The wiper insert 401 is mounted to the wiper holder 403 by a pair of button-head screws 409 at small recesses 411 located approximately mid-length of the bore 407, as shown in FIGS. 4A and 4B. The wiper insert 401 is further secured to the wiper holder 403 by a lip 413 extending from its outside diameter and overlapping the back end of the holder 403. These mounting features 411 413, by exploiting the direction of the forces being applied to the wiper die assembly 400 during the tube-bending process, obviate the need to interrupt the surface of the bore 407 with tapped holes, like the mounting 305 shown in FIG. 3C. The wiper insert 401 is a disposable component of the high-pressure wiper die assembly and is intended to be discarded when worn out. It will generally be made of either alloy steel or aluminum-bronze depending upon the material of the tube, although it can be made of any machinable material including plastic.

The wiper holder 403 provides most of the mass of the high-pressure wiper die assembly 400. To it are attached the wiper insert 401 and the radius face support shoe 405, as shown in FIGS. 4A and 4B. In turn, the wiper holder 403 has one or more tapped holes 415 towards the back of it by means of which the entire wiper die assembly 400 can be attached to the rotary-draw tube-bending machine (not shown). The length and width of the wiper holder 403 will vary with the size of the tube to be bent. Its height will vary with the radius of the tube bend so that the radius face of the entire assembly 400 will cover a sweep of approximately ninety degrees from the feather edge 417 of the wiper insert 401 to the top of the support shoe 405. Because the radius face 419 of the wiper insert 401 and the nose 421 of the support shoe 405 provide the critical bearing surfaces against the bend die cavity (not shown) for the wiper die assembly 400, the radius face 423 of the wiper holder 403 is recessed in a manner similar to the wiper holder 301 depicted in FIG. 3A to prevent unnecessary wear. The wiper holder 403 is permanent component of the high-pressure wiper die assembly 400 and generally will not wear out under normal use. It is made of alloy steel to enhance its durability.

The radius face support shoe 405 extends beyond the radius face 423 of the wiper holder 403 into direct contact with the bend die cavity to support and stabilize the entire wiper die assembly while under high pressure during the tube-bending process. As a consequence the nose 421 of the support shoe 405 will wear over time. Therefore, the shoe 405 can be advanced forward relative to the radius face 423 of the holder 403 so that its 421 continues to make direct contact with the bend die cavity. To this end, the shoe 405 is mounted to the holder 403 by a pair of socket-head cap screws 425 through a counterbored slot, as shown in FIG. 4A, to allow this forward adjustment. Furthermore, this forward adjustment is precisely controlled by a pair of pusher screws 427 at the back end of the shoe 405, as shown in FIGS. 4A and 4B. The support shoe 405 is, like the wiper insert 401, a disposable component of the high-pressure wiper die assembly 400 and is intended to be discarded when worn out. It is generally made of bronze because of its function as a bearing, although it can also be made of other types of material that do not deform under high-pressure tube-bending yet minimize friction.

This assembly 400 of wiper insert 401, wiper holder 403, and radius face support shoe 405 effectively combines those characteristics of a solid-body wiper die 200 that facilitate high-pressure rotary-draw tube-bending with those characteristics of a standard inserted wiper die 300 that lower the cost of the tube-bending process. This is because: [1] The sleeve-type wiper insert 401 has a bore 407 with a continuous uninterrupted working surface like the bore 205 of the solid-body wiper die 200, yet is a replaceable component like the wiper insert 303 of the standard inserted wiper die 300; [2] the wiper holder 403 has a mass similar to the block 201 of the solid-body wiper die 200, yet no working surfaces subject to intensive wear like the wiper holder 301 of the standard inserted wiper die 300; and [3] the radius face support shoe 405 provides the support and stability for the entire assembly 400 during high-pressure tube-bending as does the radius face 207 of the solid-body wiper die 200, yet is a replaceable component that obviates the need to re-machine or discard the wiper die assembly 400 when it is worn out, unlike the solid-body wiper die 200 when its radius face 207 is worn out. It is the support shoe 405 that makes the high-pressure wiper die assembly 400 effective as an inserted tool for high-pressure tube-bending and can be used for any current tube-bending application in place of a solid-body wiper die 200.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. An adjustable inserted wiper die for use in tube bending comprising:

a replaceable wiper insert for providing a tube bearing surface;

an adjustable support shoe having a radius face for placement into a bend die cavity for supporting the inserted wiper die such that a nose of the support shoe can be adjusted relative to the radius face using at least one pusher screw; and wherein the wiper insert is pocketed into the wiper die at one end and includes a feathered edge at its opposite end.

2. A wiper die assembly as in claim 1, wherein the nose is adjusted to substantially replicate the is adjustable for substantially replicating a bearing surface of the radius face of a solid-body wiper die.

3. A wiper die assembly as in claim 1, wherein the adjustable support shoe is made of a non-galling material for preventing deformation under a substantially high-pressure bending of a tube.

4. A wiper die assembly as in claim 3, wherein the non-galling material is bronze.

5. A wiper die assembly for use in a high-pressure rotary-draw process for bending a tube comprising:

a replaceable wiper insert for providing a bearing surface against the tube to be bent, and a feathered edge to prevent wrinkling of the inside radius of the tube bend;

an adjustable radius face support shoe having a nose at its end positioned in a cavity of the bend die for supporting the wiper assembly;

a wiper holder for attaching the wiper insert and the support shoe such that the nose is adjusted relative to a radius of the wiper holder using at least one pusher screw; and wherein the wiper insert is pocketed into the wiper holder at one end and includes a feathered edge at its opposite end.

6. A wiper die assembly as in claim 5, wherein the wiper insert is held in position to the wiper holder by means of mechanical fasteners outside the area of its base so that the bore retains a substantially uninterrupted surface.

7. A wiper die assembly as in claim 5, wherein the radius face support shoe is held in position to the wiper holder using at least one mechanical fastener after adjustment of the nose.

8. A wiper die assembly as in claim 5, wherein the nose of the radius face support shoe is adjustable to substantially replicate the bearing surface of the radius face of a solid-body wiper die.

9. A wiper assembly as in claim 7, wherein the adjustable radius support shoe is made of a non-galling material for preventing deformation under substantially high-pressure tube bending.

10. A wiper die assembly as in claim 9, wherein the non-galling material is bronze.

11. A method for producing a wiper die system for use in a high-pressure rotary-draw tube-bending process comprising the steps of:

using a replaceable wiper insert to provide a bearing surface against a tube to be bent, and a feathered edge to prevent wrinkling of the inside radius of the tube bend;

using an adjustable radius face support shoe to fit into the cavity of the bend die to support and stabilize the entire wiper assembly;

attaching the wiper insert within a pocket of a wiper holder; and adjusting a nose of the radius face support shoe for substantially replicating the bearing surface of the radius face of a solid-body wiper die.

12. A method for producing a wiper die system as in claim 11, further comprising the step of:

holding the wiper insert in position using at least one mechanical fastener outside the area of its bore so that the bore retains a substantially smooth and uninterrupted surface.

13. A method for producing a wiper die as in claim 11, further comprising the step of:

forming the adjustable radius face of a non-galling material to prevent significant deformation under a substantially high-pressure in rotary-draw tube-bending.

14. A method for producing a wiper die as in claim 13, wherein the non-galling material is bronze.

* * * * *